US008333625B2

(12) United States Patent
Feldmeier et al.

(10) Patent No.: US 8,333,625 B2
(45) Date of Patent: Dec. 18, 2012

(54) ELECTRICAL CONTACT ELEMENT FOR HIGH-CURRENT PLUG CONNECTORS AND MANUFACTURING METHOD

(75) Inventors: Guenter Feldmeier, Lorsch (DE); Horst Braun, Gummersbach (DE); Zoltan Lampert, Troisdorf (DE); Thomas Schnurpfeil, Meckenheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 69 days.

(21) Appl. No.: 12/807,936

(22) Filed: Sep. 17, 2010

(65) Prior Publication Data

US 2011/0074153 A1 Mar. 31, 2011

(30) Foreign Application Priority Data

Sep. 17, 2009 (DE) ..... 10 2009 041 919

(51) Int. Cl.
*H01R 9/24* (2006.01)

(52) U.S. Cl. ..... 439/884; 439/741

(58) Field of Classification Search ..... 439/741, 439/825, 884, 887
See application file for complete search history.

(56) References Cited

U.S. PATENT DOCUMENTS

| | | | | |
|---|---|---|---|---|
| 2,434,905 | A | 1/1948 | Burt et al. | |
| 6,601,423 | B1 | 8/2003 | Peterson | |
| 7,594,832 | B2 * | 9/2009 | Oka et al. | 439/884 |
| 2006/0199411 | A1 | 9/2006 | Singh et al. | |
| 2012/0142234 | A1 * | 6/2012 | Langhoff et al. | 439/884 |

FOREIGN PATENT DOCUMENTS

| | | | |
|---|---|---|---|
| DE | 197 03 984 | A1 | 8/1998 |
| WO | WO2008/090214 | A1 | 7/2008 |

OTHER PUBLICATIONS

European Search Report, dated Feb. 8, 2011, issued by the European Patent Office, Munich, Germany for European Application No. 10009641.1; 8 pages.

* cited by examiner

*Primary Examiner* — Khiem Nguyen
(74) *Attorney, Agent, or Firm* — Faegre Baker Daniels LLP

(57) ABSTRACT

The present invention relates to high-current plug connectors, in particular to electrical contact elements for plug connectors of this type, which are distinguished by low heating even at high currents, and to a corresponding method for manufacturing contact elements of this type. According to the invention, for this purpose, the contact element is made in one piece by internal high-pressure forming from a tubular blank. As a result, the contact element has at each point substantially the same line cross section, so that no local electrical or thermal load peaks can occur.

27 Claims, 7 Drawing Sheets

ELECTRICAL CONTACT ELEMENT FOR HIGH-CURRENT PLUG CONNECTORS AND MANUFACTURING METHOD

The present invention relates to high-current plug connectors for wind power plants, in particular to electrical contact elements for plug connectors of this type, and also to a corresponding manufacturing method.

BACKGROUND

In wind power plants with a horizontal rotor axis, the generator is conventionally accommodated in direct proximity to the rotors in the gondola at the tip of the tower. The power cables, which connect the generator to the mains power supply at the foot of the tower, are laid on the inner wall of the tower. In order to simplify assembly of the overall wind power plant, the tower is composed of individual preassembled segments. Each of these segments already contains in particular a corresponding portion of the cabling. Over the course of the assembly of the tower, the cable portions of the individual segments are joined together. The difficulties and the considerable costs of subsequent cabling can be avoided in this way.

US document US 2006/0199411 discloses an improved cable system for a wind power plant, in which the cable portions of each tower segment are provided at both ends with plug connectors, with the aid of which the individual cable portions are joined together during the assembly of the tower. This is intended to simplify both the assembly and the maintenance of the cabling.

The plug connectors used for connecting the power cable portions and the contact elements of the plug connectors have to be adapted to the increased electrical and mechanical requirements.

A high-current contact element made of a sheet metal stamped part is known from document DE 197 03 984 A1. This conventional contact element has a contact region in the form of a contact socket or a contact pin for contacting a matching mating contact element, the contact region having a large number of resilient contact points. Each of these resilient contact points consists of a spring tongue which is formed by correspondingly stamped out cutouts in the sheet metal stamped part.

However, this conventional high-current contact element has the drawback that the available line cross section is restricted by the cutouts which are indispensable for forming the spring tongues. Under appropriate current loads, this leads to intensive local heating of the contact element and can even lead to overheating of the plug connector as a whole.

SUMMARY OF THE INVENTION

The object of the present invention is therefore to specify an electrical contact element for a high-current plug connector that displays lower heating under the same current loads. A further object of the present invention is to specify an electrical contact element for a high-current plug connector that allows the plug connector to be produced in a cost-effective manner. It is also an object of the present invention to disclose a method for manufacturing contact elements of this type.

This is achieved by the features of the independent claims. Preferred embodiments form the subject-matter of the dependent claims.

The particular approach of the present invention is to make the electrical contact element in one piece by internal high-pressure forming from a tubular blank.

According to a first aspect of the present invention, an electrical contact element is provided for a high-current plug connector. The contact element comprises a contact region in the form of a contact pin or a contact socket for contacting a matching mating contact element and a connection region for receiving a connection cable, and is characterised in that the contact element is made in one piece by internal high-pressure forming from a tubular blank.

The wall thickness of the contact element which is shaped by internal high-pressure forming can be defined in accordance with the required demands placed on the contact element. Preferably, however, the wall thickness is between 2 mm and 5 mm, particularly preferably 3.5 mm. The length of the contact element which is embodied as a contact pin is preferably between 140 mm and 160 mm, particularly preferably 150 mm. The length of the contact element which is embodied as a contact socket is preferably between 120 mm and 140 mm, particularly preferably 130 mm.

Preferably, the line cross section of the contact element is substantially constant over the entire length of the contact element. In this way, the thermal and electrical loading of the contact element is distributed uniformly over the entire contact element. At the same time, local excessive heating of the contact element on account of the flow of current is prevented. The contact element thus remains cooler overall.

Preferably, the contact element is made of copper or a copper alloy. A high conductivity of the contact element can be ensured in this way.

Preferably, the contact region and/or the connection region is shaped in a substantially cylindrical manner. This facilitates the receiving of the connection cable or the contacting of the matching mating contact element.

Preferably, the contact region has a cross section, the longitudinal extent of which exceeds its transverse extent. In this way, a plurality of high-current plug connectors can be arranged next to one another in a compact manner without the available line cross section having to be reduced.

Advantageously, the contact region is delimited by a lug formed in the contact element towards the connection region. This lug can serve as a mechanical stop during plugging into the associated mating contact element.

Advantageously, the contact region has a peripheral bead for receiving an annular spring contact element. This bead allows the spring contact element to be mechanically fixed in the contact element. This reliably prevent the spring contact from slipping during plugging-in or unplugging.

The length of the connector housing is preferably between 160 mm and 220 mm, particularly preferably approx. 195 mm. The length of the coupling housing is preferably between 180 mm and 230 mm, particularly preferably 210 mm. The total length of the high-current plug connector when plugged-in is preferably between 320 mm and 380 mm, particularly preferably approx. 350 mm.

According to a second aspect of the present invention, a high-current connector is provided. The high-current connector comprises a connector housing and an electrical contact element according to the first aspect in the form of a contact pin, the contact element being locked to the connector housing.

Advantageously, the high-current connector further comprises a seal which is arranged at an end side of the connector housing and enters into abutment with a corresponding coupling when plugged together therewith. In this way, the infiltration of fluids, such as for example water or oil, into the plugged-together plug connector can be reliably prevented.

According to a third aspect of the present invention, a high-current coupling is provided. The high-current coupling comprises a coupling housing and an electrical contact element according to the first aspect in the form of a contact socket, the contact element being locked to the coupling housing.

The high-current coupling can also comprise an annular spring contact element which is arranged in the bead of the contact element and is embodied in such a way that the matching mating contact element can be enclosed by the spring contact element and as a result held clamped in the high-current coupling. The spring contact element can ensure the required contact pressure.

Advantageously, the high-current coupling further comprises a seal which is arranged at an end side of the coupling housing and enters into abutment with a corresponding connector when plugged together therewith. In this way, the infiltration of fluids, such as for example water or oil, into the plugged-together plug connector can be reliably prevented.

According to a further aspect of the present invention, a high-current plug connector is provided. The high-current plug connector comprises a high-current connector according to the second aspect and a high-current coupling according to the third aspect, at least the connector housing or the coupling housing being provided with a catch arm which engages into an aperture of the associated contact element and locks the associated contact element in the connector housing or coupling housing, and the catch arm being barred, when the high-current plug connector is plugged in, by a part of the respective other housing or contact element.

According to a further aspect of the present invention, a cable system is provided for a wind power plant with a tower made up of a plurality of tower segments. The cable system comprises a cable made up of a conductor and an insulation encasing the conductor, a high-current connector according to the second aspect, which is connected at one end of the cable to the conductor, and a high-current coupling according to the third aspect, which is connected at the other end of the cable to the conductor.

Preferably, the length of the cable is adapted to the height of the individual tower segments, so that each tower segment can contain its own preassembled cable system. During the assembly of the tower, only the individual cable segments need then be plugged together. The length of the cable is in this case 15 m to 25 m, preferably 20 m.

Preferably, the conductor is formed from copper wire and has a cross section of from 25 $mm^2$ to 400 $mm^2$, preferably 150 $mm^2$, 185 $mm^2$, 240 $mm^2$, or 300 $mm^2$ auf. Alternatively, the conductor can also be formed from aluminium wire and have a cross section of from 50 $mm^2$ to 400 $mm^2$, preferably 185 $mm^2$, 240 $mm^2$, 300 $mm^2$, or 400 $mm^2$. The invention is not restricted in this regard to the specified cross section values. On the contrary, higher or lower values, including in particular intermediate values, can also be used, depending on the technical requirements.

According to a further aspect of the present invention, a wind power plant with a cable system according to the invention is provided.

Finally, the present invention also specifies a method for manufacturing an electrical contact element for a high-current connector. The method includes the step: making the contact element in one piece with a contact region in the form of a contact pin or a contact socket for contacting a matching mating contact element and a connection region for receiving a connection cable by internal high-pressure forming from a tubular blank.

The invention will be described hereinafter with reference to the appended illustrations, in which.

In the illustrations, like reference numerals denote like components.

DETAILED DESCRIPTION

Figure 1A:
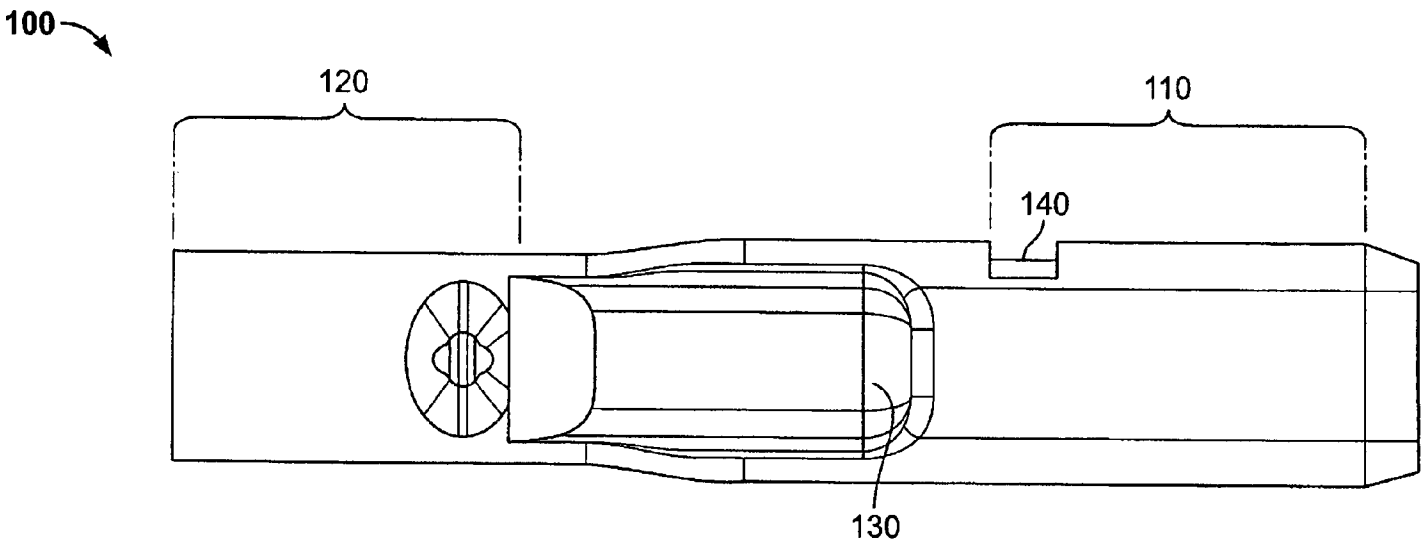
FIG. 1A is a plan view of the electrical contact element according to a first embodiment of the present invention.
Figure 1B:
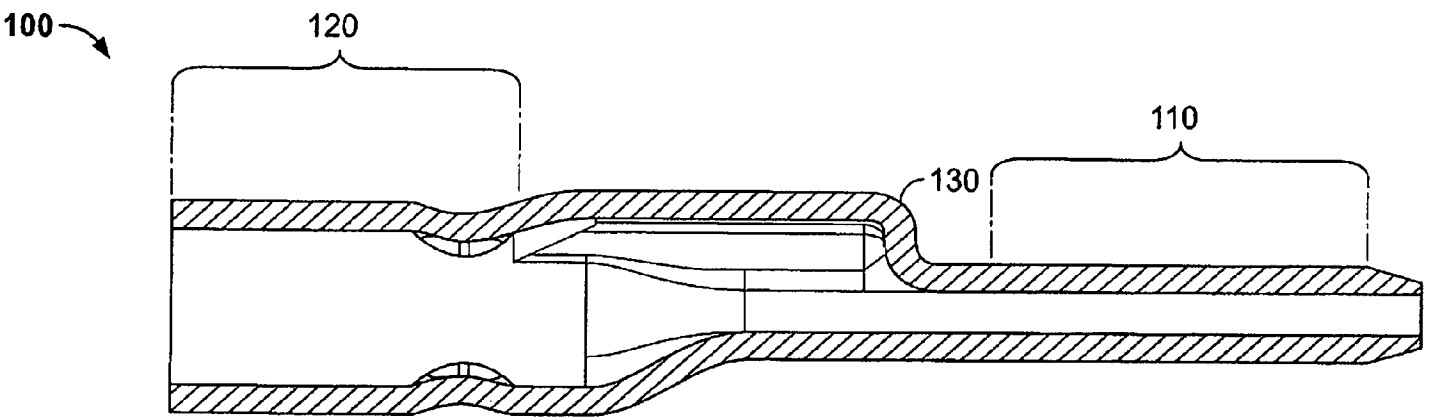
FIG. 1B is a longitudinal section through the contact element from FIG. 1A.
Figure 1C:
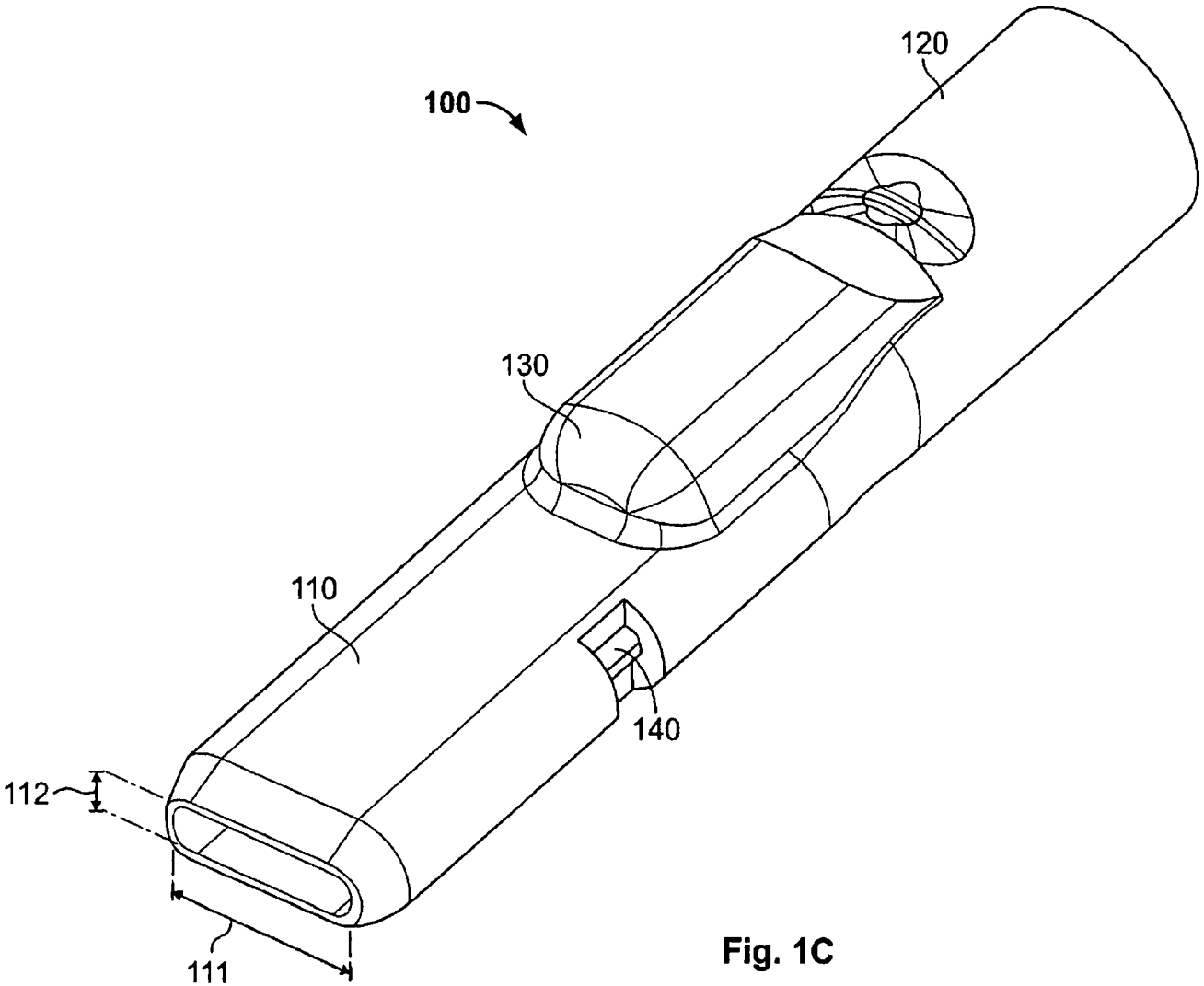
FIG. 1C is a perspective view of the contact element from FIG. 1A.

FIGS. 1A to 1C are a plan view, a longitudinal section and a perspective view respectively of the electrical contact element 100 according to a first embodiment of the present invention, the electrical contact element being designed as a contact pin. The contact element has a contact region 110 (plug-in region) which can be plugged into a correspondingly shaped mating contact element. This region is embodied in a substantially cylindrical manner, wherein the leading edge can be bevelled or rounded off to facilitate the plug-in process. The length of the contact region 110 may be about 61 mm. The total length of the contact element 100 may be 151 mm.

The contact region 110 has preferably a non-circular cross section, the longitudinal extent 111 of which exceeds the transverse extent 112. This cross section may be in particular oval or rectangular, wherein the corners can be rounded off. In this way, a plurality of plug connectors can be arranged next to one another in a compact manner, the required line cross section being ensured at the same time.

The end of the contact element opposing the contact region 110 is shaped as a connection region 120 and serves to receive the connection cable. The connection region is preferably embodied as a circular cylinder and adapted to the diameter of the connection cable. Typically, the connection region has an inner diameter of between 20 mm and 32 mm at a cable cross section of up to 400 $mm^2$. In a particularly preferred embodiment, the connection region is embodied as a crimp connection, so that the connection cable can be connected to the contact element by pressing.

A lug 130, in the form of a stepped projection on the contact element, is formed in the region of transition between the contact region 110 and the connection region 120, the lug entering into abutment with the mating contact element and thus serving as a stop when completely plugged-in.

According to the invention, the contact element is made by internal high-pressure forming ("hydroforming") from a tubular blank. In this case, the blank is placed into a correspondingly shaped negative mould, filled with a fluid, in particular with a water-oil suspension, and closed at both ends using hydraulic pistons. As a result of controlled compression and an increase in internal pressure, the blank is plastically deformed, so that it assumes the shape predefined by the negative mould. In this way, complex designs may be implemented reliably and cost-effectively.

On account of the manner in which it is manufactured from a tubular blank (for example copper pipe), the contact element has substantially the same line cross section at each point. The line cross section is therefore substantially constant in the longitudinal direction, so that the electrical resistance in the longitudinal direction is also substantially the same at each point. The contact element according to the invention is therefore heated uniformly by the flowing current. Local thermal load peaks do not occur. The contact element according to the invention therefore remains cooler than conventional contact elements on use of the same materials. A higher current carrying capacity in a smaller design is thus possible.

In contrast to conventional stamped shaped parts, the contact element according to the invention has in addition a closed surface. In particular, the flow of current is at no point restricted by cutouts or apertures. For this reason too, the contact element according to the invention is heated uniformly by the flowing current and local thermal or electrical load peaks are avoided.

In a particularly preferred embodiment, the contact element 100 has a notch or aperture 140 which is arranged laterally on the contact region and with which the contact element can be locked to a projection formed on the inner walls of an insulating housing. The aperture 140 can for example be formed by milling in a separate operation after the high-pressure forming. Preferably, the depth of the aperture 140 is less than the material thickness of the contact element, so that the flow of current remains substantially unrestricted.

It is also particularly advantageous to produce the contact element in one piece with the contact region and connection region, thus greatly simplifying both the production of the contact element and the production of the complete high-current plug-in connection.

In a particularly advantageous manner, a plurality of contact elements can be simultaneously shaped from a correspondingly long blank and subsequently separated from one another, for example by sawing, in a second step.

In order to achieve optimum electrical conductance, the contact elements are made preferably of copper or a copper alloy.

Figure 2A:
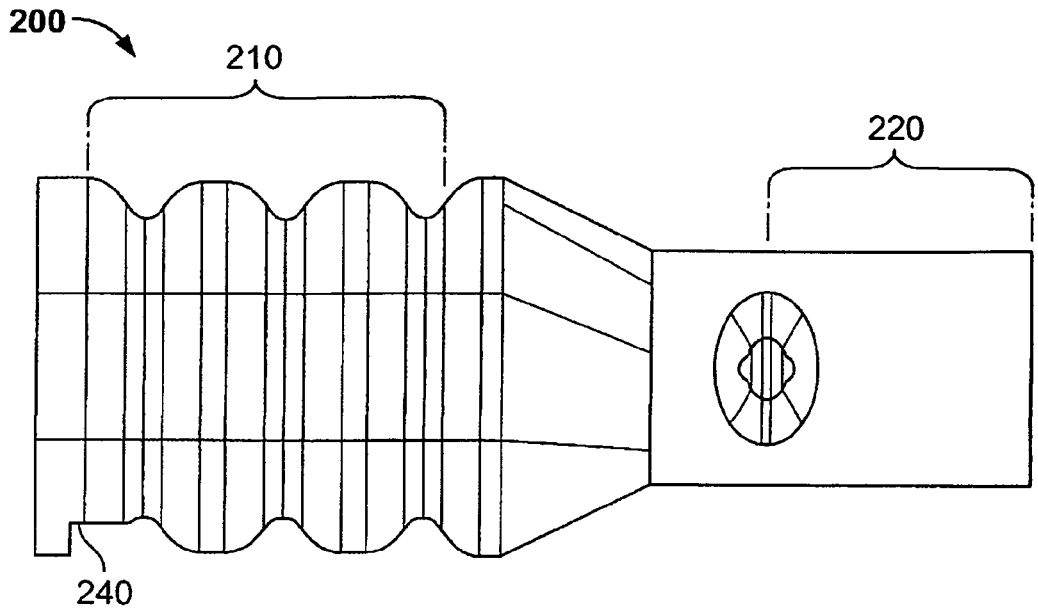
FIG. 2A is a plan view of the electrical contact element according to a second embodiment of the present invention.
Figure 2B:
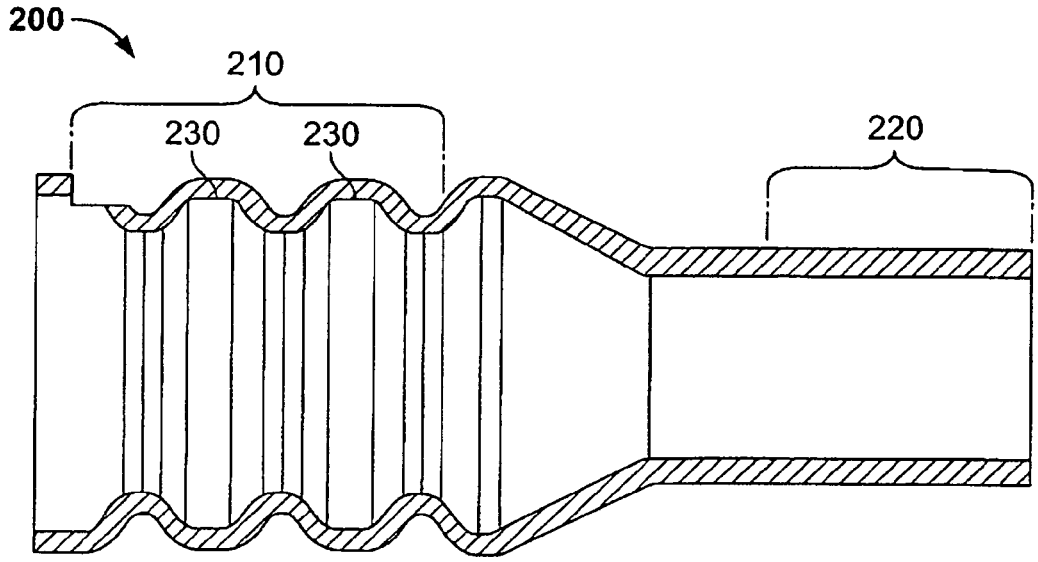
FIG. 2B is a longitudinal section through the contact element from FIG. 2A.
Figure 2C:
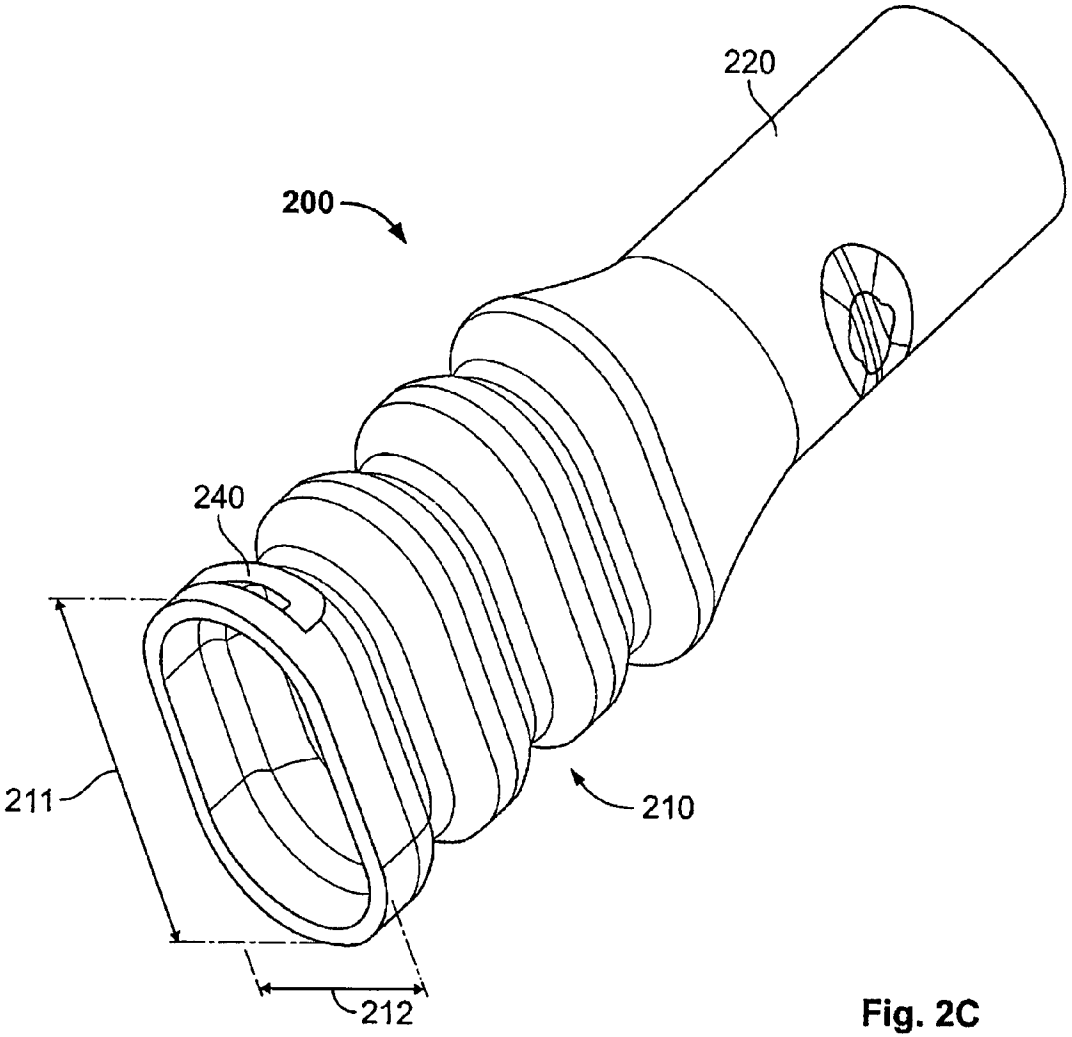
FIG. 2C is a perspective view of the contact element from FIG. 2A.

FIGS. 2A to 2C are a plan view, a longitudinal section and a perspective view respectively of the electrical contact element 200 according to a second embodiment of the present invention, the electrical contact element being designed as a contact socket. The contact element has a contact region 210 (plug-in region) into which a correspondingly shaped mating contact element, in particular the contact element according to the first embodiment, can be plugged. The cross section of the contact region is adapted to the cross section of the mating contact element to be received and has preferably a non-circular cross section, the longitudinal extent of which exceeds the transverse extent. Typical values for the long axis 211 and the short axis 212 of the oval outer cross section are about 50 mm and 30 mm respectively. As mentioned hereinbefore, this cross section may in particular be oval or rectangular, wherein the corners can be rounded off. In this way, a plurality of plug connectors can be arranged next to one another in a compact manner, the required line cross section being ensured at the same time. The total length of the contact element 200 may be 131 mm.

The end of the contact element opposing the contact region 210 is shaped as a connection region 220 and serves to receive the connection cable. The connection region is preferably embodied as a circular cylinder and adapted to the diameter of the connection cable. In a particularly preferred embodiment, the connection region is embodied as a crimp connection, so that the connection cable can be connected to the contact element by pressing.

As may be seen from FIGS. 2A to 2C, the contact region can in addition have a diameter which varies in the longitudinal direction. The bulges or beads 230 formed as a result can each serve to receive an annular spring contact element, in particular in the form of a toroidal spiral spring. These spring contact elements can surround the contact pin, once it has been introduced into the contact socket, and thus ensure the required contact pressure.

According to the invention, the contact element according to the second embodiment is also made by internal high-pressure forming from a tubular blank. Therefore, the contact element has at each point substantially the same line cross section. The line cross section is therefore substantially constant in the longitudinal direction, so that the electrical resistance in the longitudinal direction is also substantially the same at each point. The contact element according to the invention is therefore heated uniformly by the flowing current. Local thermal load peaks do not occur. The contact element according to the invention therefore remains cooler than conventional contact elements on use of the same materials.

In contrast to conventional stamped shaped parts, the contact element according to the second embodiment also has a closed surface. In particular, the contact element according to the invention does not have any stamped-free catch lugs for mechanically fixing the spring contact elements. The flow of current is therefore at no point restricted by cutouts or apertures. For this reason too, the contact element according to the invention is heated uniformly by the flowing current and local thermal or electrical load peaks are avoided.

In a particularly preferred embodiment, the contact element 200 has a notch or aperture 240 which is arranged on the contact region and with which the contact element can be locked to a projection formed on the inner walls of an insulating housing. The aperture 240 can for example be formed by milling or drilling in a separate operation after the high-pressure forming. Preferably, the aperture 240 is arranged at the outer end of the contact region, so that the flow of current remains substantially unrestricted.

Figure 3A:
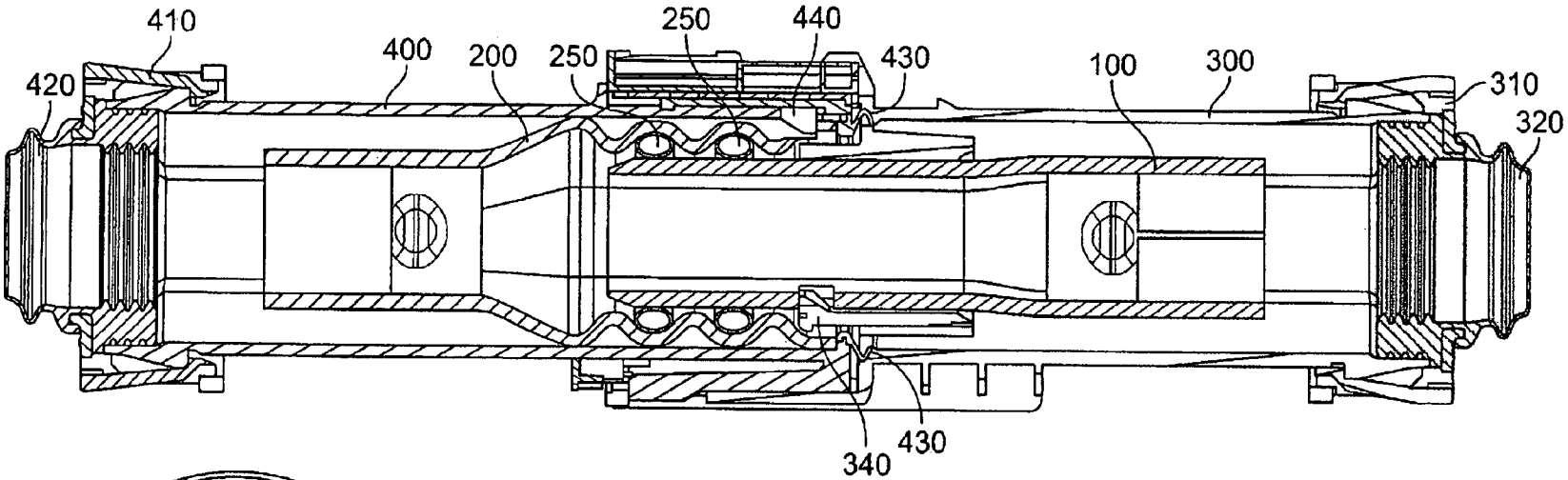
FIG. 3A is a longitudinal section through a high-current plug connector according to the invention.
Figure 3B:
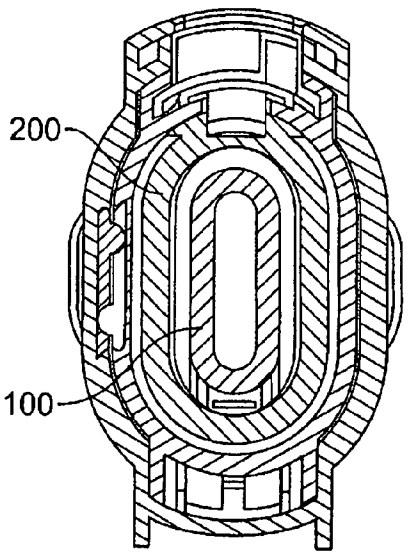
FIG. 3B is a cross section through the high-current plug connector according to the invention from FIG. 3A.
Figure 3C:
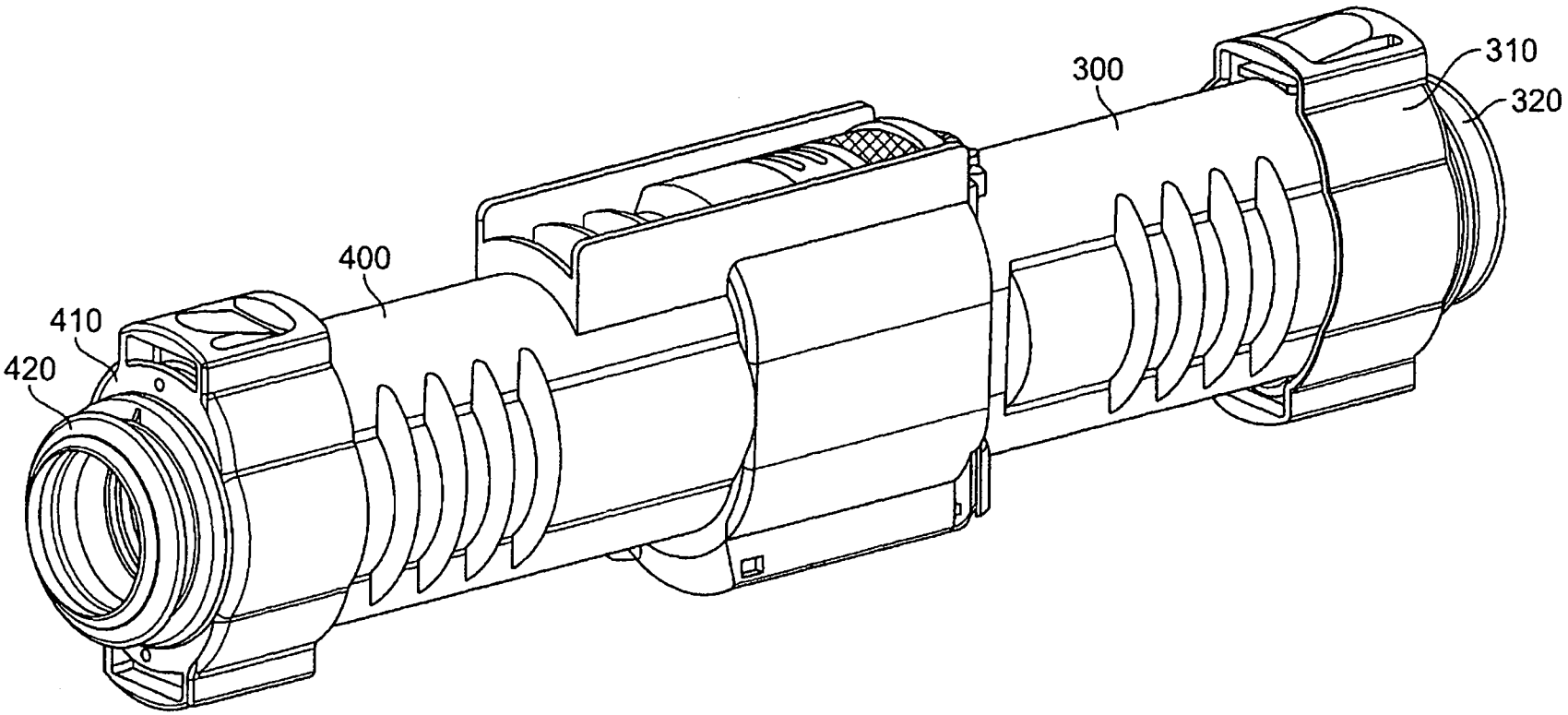
FIG. 3C is a perspective view of the high-current plug connector according to the invention from FIG. 3A.

FIGS. 3A to 3C are a longitudinal section, a cross section and a perspective view of a high-current plug connector according to a further aspect of the present invention. The high-current plug connector comprises a high-current connector with a connector housing 300 and a first contact element 100 locked therein according to the first embodiment and also a high-current coupling with a coupling housing 400 and a second contact element, which is likewise locked therein, according to the second embodiment of the present invention. Annular spring contact elements 250, which, when plugged-in, surround the first contact element 100 and ensure the required contact pressure, are arranged in the beads of the second coupling element 200.

In order to lock the contact elements to the respective housing, the contact elements can be provided with a recess 140, 240 with which a corresponding catch lug 340, 440 of the associated housing engages. The recess is made on the formed part, for example by milling, preferably subsequently. Preferably, the housings are configured in such a way that at least one of the catch lugs 340, 440 is barred, when the plug connector is plugged in, by a part of the respective other housing or the other contact element.

In order to prevent oil or water from infiltrating the plug connector, seals are provided both at the cable side and at the joint between the connector and coupling. The cable-side seals consist of bellows 320, 420 which enclose the cable in the manner of a cable bushing. This cable seal can be preassembled on a housing closure part 310, 410 and be locked to the actual connector/coupling housing in a simple manner. For sealing the joint between the connector and coupling, bellows 430 are preferably provided on the end side of the coupling housing as a face seal. This seal can additionally comprise a moulded-on geometry, with the aid of which the barring hook 440 is also sealed.

Figure 4B:
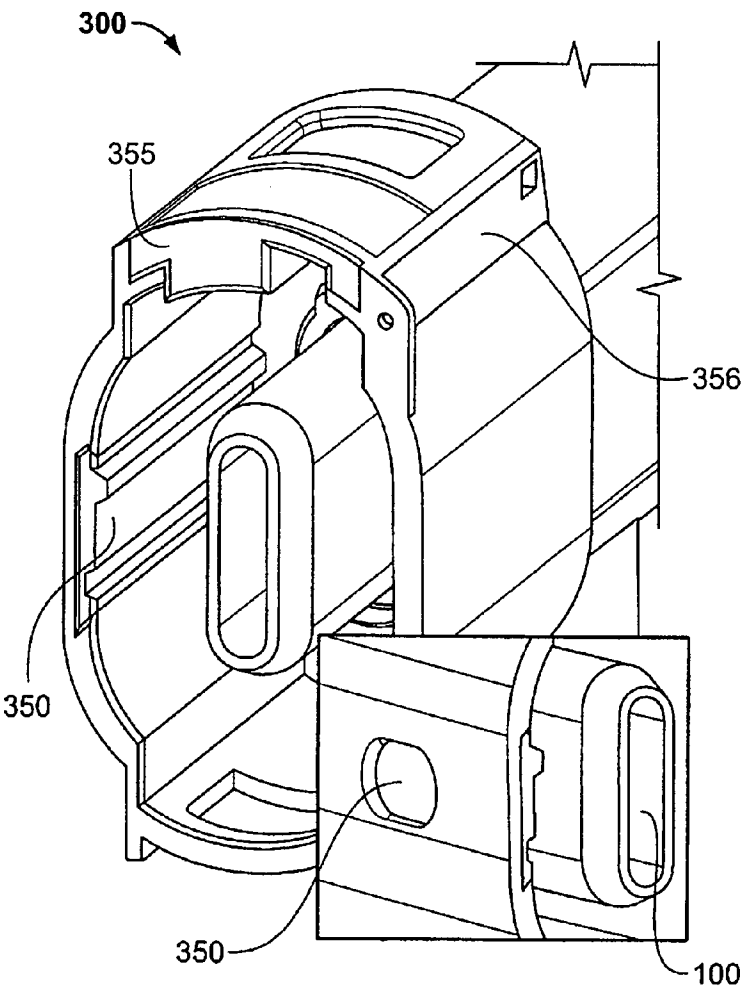
FIG. 4B is a perspective detail-type view of the connector of the high-current plug connector according to the invention from FIG. 3A.
Figure 4A:
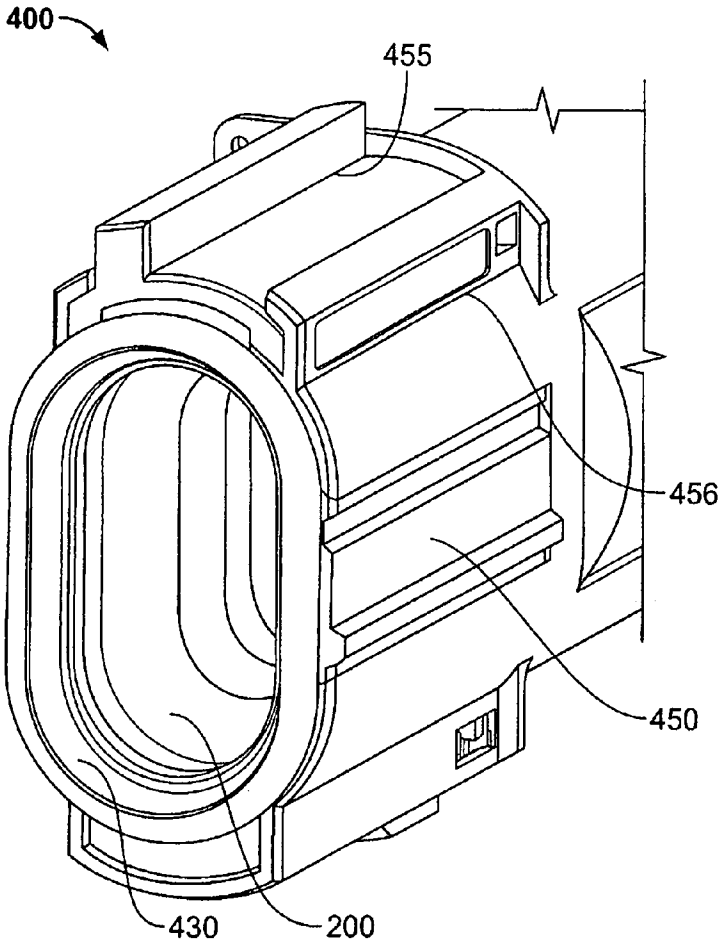
FIG. 4A is a perspective detail-type view of the coupling of the high-current plug connector according to the invention from FIG. 3A.

FIGS. 4A and 4B are a perspective detail-type view of the coupling and the connector respectively of the high-current plug connector according to the invention from FIG. 3A. The bellows 430 for sealing the joint between the connector and coupling may clearly be seen. Phase coding elements 355, 455 and cable coding elements 350, 450 may also be seen. These coding elements have a web and a groove respectively which are arranged in such a way that they mesh during plugging-together of the connector and coupling which are provided with similar coding elements. In the case of non-similar coding elements, the plugging-together is mechanically prevented. Accidental reversal of the polarity of the cables arranged next to one another or the undesired connection of different cables can be reliably prevented in this way. The coding elements are exchangeable, so that the plug connectors are configurable in any desired way. Preferably, the coding elements can be inserted into corresponding apertures of the connector or coupling housing and can be locked by means of suitable catch lugs and apertures 356, 356.

The present invention therefore relates to high-current plug connectors, in particular to electrical contact elements for plug connectors of this type, which are distinguished by merely low heating even at high currents, and to a corresponding method for manufacturing contact elements of this type. According to the invention, for this purpose, the contact element is made in one piece by internal high-pressure forming from a tubular blank. As a result, the contact element has at each point substantially the same line cross section, so that no local electrical or thermal load peaks can occur.

The invention claimed is:

1. An electrical contact element for a high-current plug connector, comprising:

a contact region in the form of a contact pin or a contact socket for contacting a matching mating contact element;

a connection region for receiving a connection cable; wherein the contact element is made in one piece by internal high-pressure forming from a tubular blank, to define a seamless tubular element having varying cross sectional dimensions as measured along a longitudinal axis.

2. Electrical contact element according to claim 1, wherein the wall thickness of the contact element is substantially constant over the entire length of the contact element.

3. Electrical contact element according to claim 1, wherein the contact element is made of copper or a copper alloy.

4. Electrical contact element according to claim 1, wherein the contact region and/or the connection region is shaped substantially cylindrically.

5. Electrical contact element according to claim 1, wherein the contact region has a longitudinal extent of which exceeds its transverse extent.

6. Electrical contact element according to claim 1, wherein the contact region is delimited towards the connection region by a lug formed in the contact element.

7. Electrical contact element according to claim 1, wherein the contact region has at least one peripheral bead for receiving an annular spring contact element.

8. High-current connector, comprising:

a connector housing; and an electrical contact element having a contact region in the form of a contact pin or a contact socket for contacting a matching mating contact element; a connection region for receiving a connection cable; wherein the contact element is made in one piece by internal high-pressure forming from a tubular blank, and defines a seamless tubular element having varying cross sectional dimensions as measured along a longitudinal axis, and wherein the electrical contact element is locked to the connector housing.

9. High-current connector according to claim 8, further comprising a seal which is arranged at an end side of the connector housing and enters into abutment with a corresponding coupling when plugged together therewith.

10. High-current coupling, comprising:

a coupling housing; and an electrical contact element having a contact region in the form of a contact socket for contacting a matching mating contact element; a connection region for receiving a connection cable; wherein the contact element is made in one piece by internal high-pressure forming from a tubular blank, to define a seamless tubular element having varying cross sectional dimensions as measured along a longitudinal axis, and wherein the electrical contact element is locked to the coupling housing.

11. High-current coupling according to claim 10, further comprising an annular spring contact element which is arranged in a bead of the electrical contact element and is embodied in such a way that the matching mating contact element can be enclosed by the spring contact element and as a result held clamped in the high-current coupling.

12. High-current coupling according to claim 10, further comprising a seal which is arranged at an end side of the coupling housing and enters into abutment with a corresponding connector when plugged together therewith.

13. High-current plug connector for a wind power plant, comprising:

a high-current connector, comprised of:

a connector housing; and an electrical contact element having a contact region in the form of a contact pin or a contact socket for contacting a matching mating contact element; a connection region for receiving a connection cable; wherein the contact element is made in one piece by internal high-pressure forming from a tubular blank and defines a seamless tube, and wherein the electrical contact element is locked to the connector housing; and a high-current coupling, comprised of:

a coupling housing; and an electrical contact element having a contact region in the form of a contact socket for contacting a matching mating contact element; a connection region for receiving a connection cable; wherein the contact element is made in one piece by internal high-pressure forming from a tubular blank and defines a seamless tube, and wherein the electrical contact element is locked to the coupling housing.

14. High-current plug connector of claim 13, wherein at least the connector housing or the coupling housing is provided with a catch arm which engages with an aperture of the associated contact element and locks the associated contact element in the connector housing or coupling housing, and wherein the catch arm is barred, when the high-current plug connector is plugged in, by a part of the respective other housing or contact element.

15. Cable system for a wind power plant with a tower made up of a plurality of tower segments, comprising:

a cable made up of a conductor and an insulation encasing the conductor;

a high-current connector, comprised of:

a connector housing; and an electrical contact element having a contact region in the form of a contact pin or a contact socket for contacting a matching mating contact element; a connection region for receiving a connection cable; wherein the contact element is made in one piece by internal high-pressure forming from a tubular blank and defines a seamless tube, and wherein the electrical contact element is locked to the connector housing; and a high-current coupling, comprised of:

a coupling housing; and an electrical contact element having a contact region in the form of a contact socket for contacting a matching mating contact element; a connection region for receiving a connection cable; wherein the contact element is made in one piece by internal high-pressure forming from a tubular blank and defines a seamless tube, and wherein the electrical contact element is locked to the coupling housing; wherein the high-current connector is connected at one end of the cable to the conductor; and the high-current coupling is connected at the other end of the cable to the conductor.

16. Cable system according to claim 15, wherein the length of the cable is adapted to the height of the individual tower segments.

17. Cable system according to claim 14, wherein the length of the cable is 15 m to 25 m, preferably 20 m.

18. Cable system according to claim 14, wherein the conductor is formed from copper wire and has a cross section of from 25 $mm^2$ to 400 $mm^2$, preferably 150 $mm^2$, 185 $mm^2$, 240 $mm^2$, 300 $mm^2$ or 400 $mm^2$.

19. Cable system according to claim 14, wherein the conductor is formed from aluminium wire and has a cross section of from 50 $mm^2$ to 400 $mm^2$, preferably 185 $mm^2$, 240 $mm^2$, 300 $mm^2$, or 400 $mm^2$.

20. A wind power plant, comprising a tower made up of a plurality of tower segments; and a cable made up of a conductor and an insulation encasing the conductor;

a high-current connector, comprised of:

a connector housing; and an electrical contact element having a contact region in the form of a contact pin or a contact socket for contacting a matching mating contact element; a connection region for receiving a connection cable; wherein the contact element is made in one piece by internal high-pressure forming from a tubular blank and defines a seamless tube, and wherein the electrical contact element is locked to the connector housing; and a high-current coupling, comprised of:

a coupling housing; and an electrical contact element having a contact region in the form of a contact socket for contacting a matching mating contact element; a connection region for receiving a connection cable; wherein the contact element is made in one piece by internal high-pressure forming from a tubular blank and defines a seamless tube, and wherein the electrical contact element is locked to the coupling housing; wherein the high-current connector is connected at one end of the cable to the conductor; and the high-current coupling is connected at the other end of the cable to the conductor.

21. Method for manufacturing an electrical contact element for a high-current connector including the step:

making the electrical contact element in one piece with a contact region in the form of a contact pin or a contact socket for contacting a matching mating contact element and a connection region for receiving a connection cable by internal high-pressure forming from a tubular blank.

22. Method according to claim 21, wherein the the wall thickness of the electrical contact element is formed so as to be substantially constant over the entire length of the contact element.

23. Method according to claim 21, wherein the electrical contact element is made of copper or a copper alloy.

24. Method according to claim 21, wherein the contact region and/or the connection region is embodied in a substantially cylindrical manner.

25. Method according to claim 21, wherein the contact region has a longitudinal extent of which exceeds its transverse extent.

26. Method according to claim 21, wherein a lug is formed in the region of transition between the contact region and the connection region for delimiting the contact region.

27. Method according to claim 21, wherein at least one peripheral bead is formed in the contact region for receiving an annular spring contact element.

* * * * *